United States Patent [19]

Smith

[11] Patent Number: 4,802,670

[45] Date of Patent: Feb. 7, 1989

[54] FOOTBALL BLOCKING APPARATUS

[76] Inventor: Dan R. Smith, 6733 Fernwood Dr., Boise, Id. 83709

[21] Appl. No.: 16,017

[22] Filed: Feb. 18, 1987

[51] Int. Cl.[4] ..... A63B 67/00

[52] U.S. Cl. ..... 273/55 R

[58] Field of Search ..... 273/55 R, 55 A; 272/135, 136, 134, 128

[56] References Cited

U.S. PATENT DOCUMENTS

| | | | |
|---|---|---|---|
| 2,696,383 | 12/1974 | Noftsinger | 273/55 R |
| 3,329,428 | 7/1967 | Moran | 273/55 R |
| 3,365,947 | 1/1968 | Janich, III | 273/55 R |
| 3,637,210 | 1/1972 | Brantley | 273/55 A |
| 3,674,265 | 7/1972 | Sheets | 373/55 R |
| 3,873,089 | 3/1975 | Krug | 373/55 R |
| 3,897,060 | 7/1975 | Jennings | 373/55 R |

*Primary Examiner*—Richard C. Pinkham
*Assistant Examiner*—T. Brown
*Attorney, Agent, or Firm*—Frank J. Dykas

[57] ABSTRACT

A football blocking apparatus having a telescoping ram assembly supported in parallel spaced relationship to a support sled. The ram assembly having a blocking pad for simulating a torso of an on-rushing defensive lineman attached to the extending end of said telescoping ram assembly and a thrust bar attached to the telescoping ram assembly for imparting thrust forces to selectively extend or retract the telescoping ram assembly to simulate the rush of a defensive lineman. The apparatus further adaptable to simulate a torso of a football player attempting a cut block.

3 Claims, 3 Drawing Sheets

FOOTBALL BLOCKING APPARATUS

BACKGROUND OF THE INVENTION

1. Field of the Invention

This invention relates to a training apparatus for teaching football blocking. More particularly to teach pass blocking techniques to offensive lineman and techniques for shedding off cut blocks to all lineman.

2. Description of the Prior Art

Advancing the ball down the field by a team playing offense, in the game of football, as it is played in the United States, is primarily accomplished by one of two methods. The first is the run, where the ball carrier runs until tackled, and the second is the offensive pass. Offensive lineman, in both cases, are charged with protecting the ball carrier or the passer, as the case may be. However, even though the generalized duty is the same, what the offensive lineman does in a passing play is distinctly different from what he is supposed to do in a running play.

The duties of an offensive lineman in a running play are to charge forward to trap, block or tackle a designated defensive player.

In a passing situation, the duty of the offensive lineman is to hold at bay a charging defensive lineman for a sufficient length of time to enable the passer to locate and throw the football to his designated receiver. Typically, the offensive lineman, in a passing situation, adopts a braced stance and slowly retreats, using either body blocks or his hands to hold back the charging defensive lineman. This is called pass blocking.

A number of training or blocking machines have been developed over the years to assist teaching defensive lineman how to effectively charge the offensive lineman. NOFTSINGER, U.S. Pat. No. 2,696,383 is a football blocking machine which teaches these skills and in addition assists in the development of increased charging strength by the simultaneous use of two players, each exerting force against the machine in opposition to one another. JENNINGS, U.S. Pat. No. 3,897,060 also teaches a device for use by charging defensive lineman. MONACO, U.S. Pat. No. 4,477,076 is another such device which assists in teaching a defensive lineman to charge at the snap of the ball.

GEORGE, U.S. Pat. No. 3,997,160 is a football training aid designed to assist a defensive lineman in acquiring the skills of pushing an offensive lineman back and to the side. ROGERS, U.S. Pat. No. 4,067,571 provides an apparatus for training the football player to maintain a predetermined wide based stance during football blocking or tackling exercises. ADDUCI, ET AL., U.S. Pat. No. 3,658,332 teaches tackling techniques against a tackling dummy suspended on a trolley for movement along a cantilever type track which can be selectively pivoted to impart evasive lateral movements to the tackling dummy.

Two tackling devices have been previously developed for teaching offensive lineman proper blocking techniques. The first is MORAN, U.S. Pat. No. 3,329,428 which stimulates a single charge of a defensive lineman. And the second is PILLARD, U.S. Pat. No. 3,514,105 which simulates a side stepping defensive lineman. No device simulates the repeated and extended charges of a defensive lineman and the techniques for simultaneously retreating and reblocking a charging defensive lineman.

The offensive lineman, in a passing play, blocks the charging defensive lineman. If the initial block is successful both the offensive lineman and the defensive lineman will encounter some recoil from the contact. The offensive lineman must then, immediately, regain his blocking stance in preparation for the next charge of the defensive lineman. The defensive lineman may repeatedly charge, and each time the offensive lineman regains his stance he is a little further back from the original line of scrimmage. In effect, his duty is to continue blocking while slowly retreating, in order to give the passer time to locate and throw the football to the intended receiver.

What is needed is a blocking apparatus which will simulate the repeated and extended charges of a defensive lineman.

In a like manner, there are certain specific blocks which are encountered by all players when attempting to make contact the passer or with a running back, and that is, a cut block. A cut block is usually defined as a movement by the person attempting to accomplish the block where he lowers his upper body and attempts to make impact with the charging defensive player. The block is low on the body of the charging player and is most easily overcome by pushing off the intended blocker or, as it is commonly called, shedding off the block. No devices have been specifically built to assist in teaching the shedding of cut block techniques.

SUMMARY OF THE INVENTION

Accordingly, it is an object of this invention to provide a football blocking apparatus which simulates the torso of an onrushing defensive lineman and the repeated charges made by said lineman during a passing play. It is another object of this invention to provide a football blocking apparatus which simulates an onrushing football player attempting to accomplish a cut block.

It is another object of this invention to provide a football blocking apparatus which is simple, safe, trouble free and inexpensive to manufacture.

These objects are accomplished by use of a football blocking apparatus which has a plurality of height adjustable vertical supports attached to and extending vertically up from a support sled. Said height adjustable vertical supports rigidly support an outer tubular frame member and hold the same in parallel spaced relationship to the sled. A telescoping ram is provided which is adapted in size and shape to be slidably received and supported by the other tubular frame member.

Attached to the telescoping end of the ram is a blocking plate covered by a suitable shock-absorbing pad. A thrust bar is provided, which is attached to and extends out from the telescoping ram through a elongated slot in the outer tubular frame and adapted to allow thrust to be applied to the telescoping ram in order to extend it out rapidly and repeatedly in a manner which simulates the repeated charges of a defensive lineman.

The blocking plate is adjustably mounted to the end of the telescoping ram so that it can be vertically oriented to simulate the torso of a charging defensive lineman, when the height adjustable vertical supports are extended upward to raise the blocking plate to a position which simulates the upper torso.

With the height adjustable vertical supports in a lowered position, the blocking plate can be rotated ninety degrees to simulate the torso of a football player attempting to execute a cut block.

The coach or trainer applies force to the thrust bar to rapidly and repeatedly extend the blocking plate and telescoping ram assembly out from the outer tubular frame. In this manner the football player can practice techniques for retreating and reassuming a correct blocking stance for repeatedly blocking a charging defensive lineman. Additionally, when the blocking apparatus is reoriented to simulate a football player attempting a cut block, the coach or trainer can again rapidly extend out the blocking plate and ram assembly to simulate the physical characteristics of a cut block in progress.

DETAILED DESCRIPTION OF PREFERRED EMBODIMENTS

Figure 1:
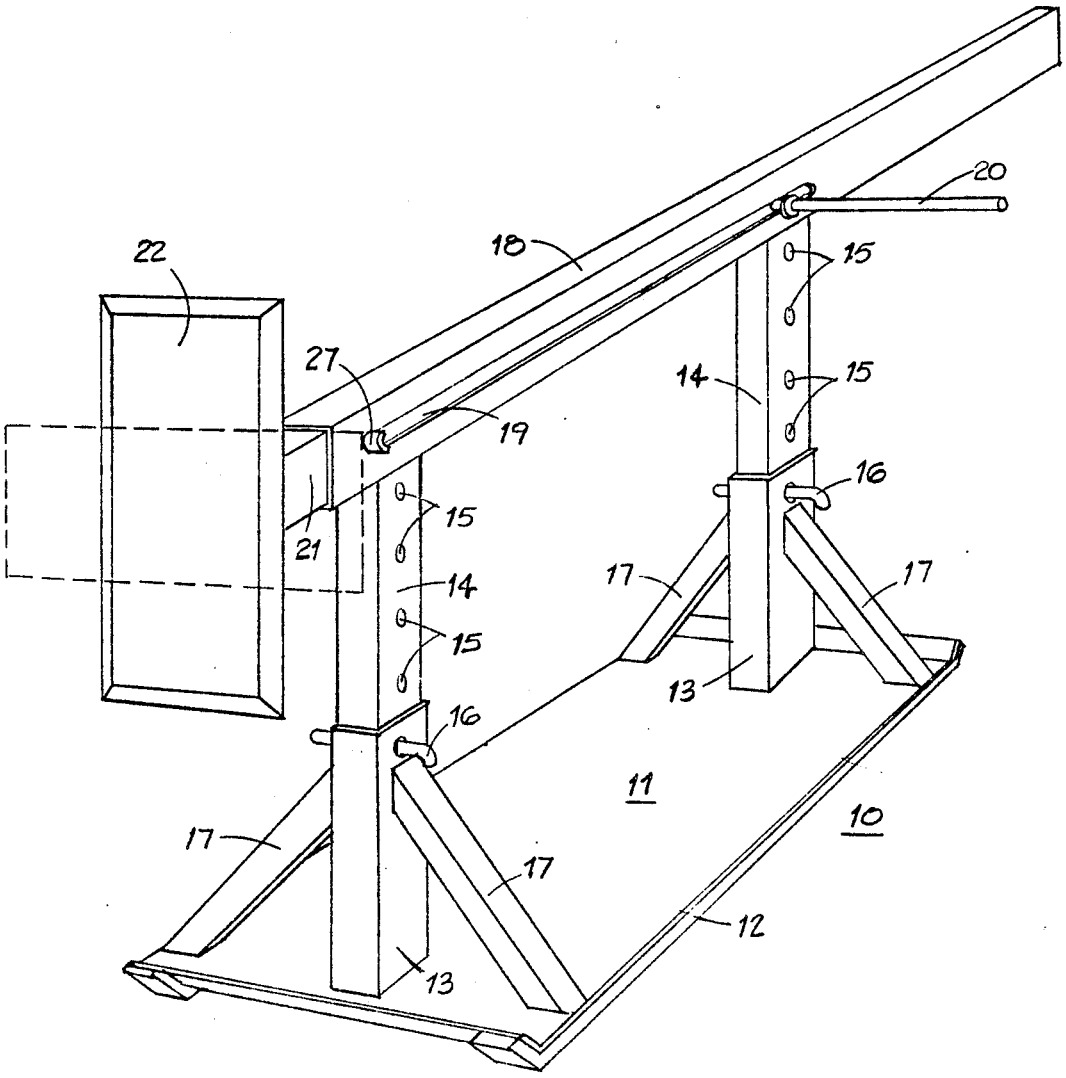
FIG. 1 is a perspective, representational view of the football blocking apparatus configured to simulate the charge of a defensive lineman in a passing play situation.
Figure 2:
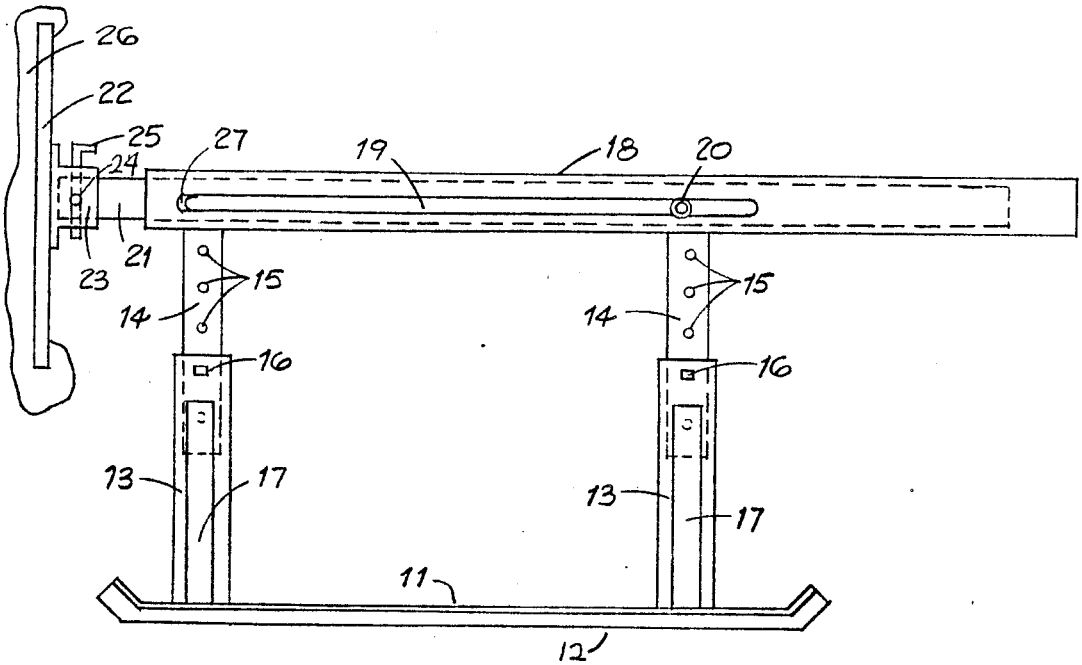
FIG. 2 is a side view of the football blocking apparatus.

First referring to FIGS. 1 and 2 my football blocking apparatus 10 is shown to advantage. Two vertical support assemblies are provided, each having lower vertical support members 13 and upper vertical support members 14 telescoping therefrom. Height adjustment holes 15 are provided for use in conjunction with height adjustment pins 16. The lower vertical support members 13 are rigidly attached to sled plate 11 and further supported and held in position by diagonal supports 17. Sled rails 12 provide additional rigid support for sled plate 11 and for directional stability in the event that the blocking apparatus 10 is slid across the ground or floor. Attached to the upper ends of upper support members 14 is outer tubular frame 18. In the preferred embodiment outer tubular frame 18 is configured in a box like shape however, it should be apparent to anyone skilled in the art that outer tubular frame 18 could just as easily be circular in shape as well as square. Slidably inserted into outer tubular frame 18 is ram 21.

Attached to ram 21 and extending perpendicularly out therefrom is thrust bar 20. Thrust bar 20 extends out through tubular frame member 18 through elongated slot 19. It can be readily seen that when force is applied to thrust bar 20, ram 21 can be quickly and forcefully extended out from outer tubular member 18. Thrust bar stop 27 is provided to protect slot 19 from distortion from repeated impacts with thrust bar 20.

In practice it has been found advantageous to allow approximately three feet of extension of ram 21 from its fully retracted position. Also, it should be noted that outer tubular frame 18 extends rearward a sufficient distance to fully encase ram 21 when fully retracted. In practice this has been found to be a significant safety feature, which protects people standing directly behind the blocking apparatus 10.

Attached to blocking plate 22 is blocking plate mounting cup 23. Blocking plate mounting cup 23 is adapted in size and shape to slide over the extending end of ram 21. Blocking plate alignment holes 24 are provided, to allow for two different orientations of blocking plate 26, the first being generally designated as a vertical alignment, and the second as a horizontal alignment. Blocking plate 22 and blocking plate mounting cup 23 are secured to ram 21 by means of pin 25.

Blocking pad 26 is provided, and made a suitable shock-absorbing padding. It can be attached to blocking plate 22 in a number of conventional ways including lacing or elastic retaining hem.

Figure 3:
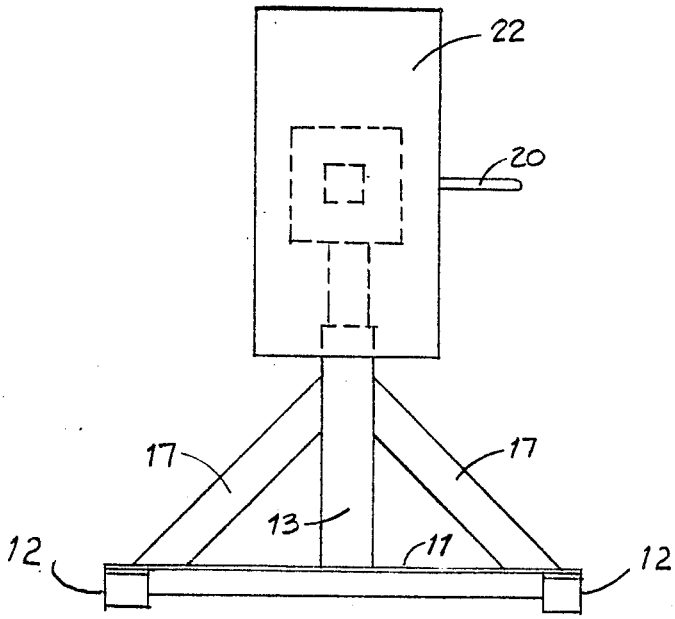
FIG. 3 is a front view.

FIGS. 1 and 3 show blocking apparatus 10 configured to simulate the upper torso of a on-rushing defensive lineman. As can be see to advantage in said drawings, blocking plate 22 is aligned vertically and thus would require the person practicing blocking to maintain his hands relatively close together and centered in order to make contact with the torso of an on-rushing defensive lineman, as simulated by blocking plate 22 and pad 26.

Figure 4:
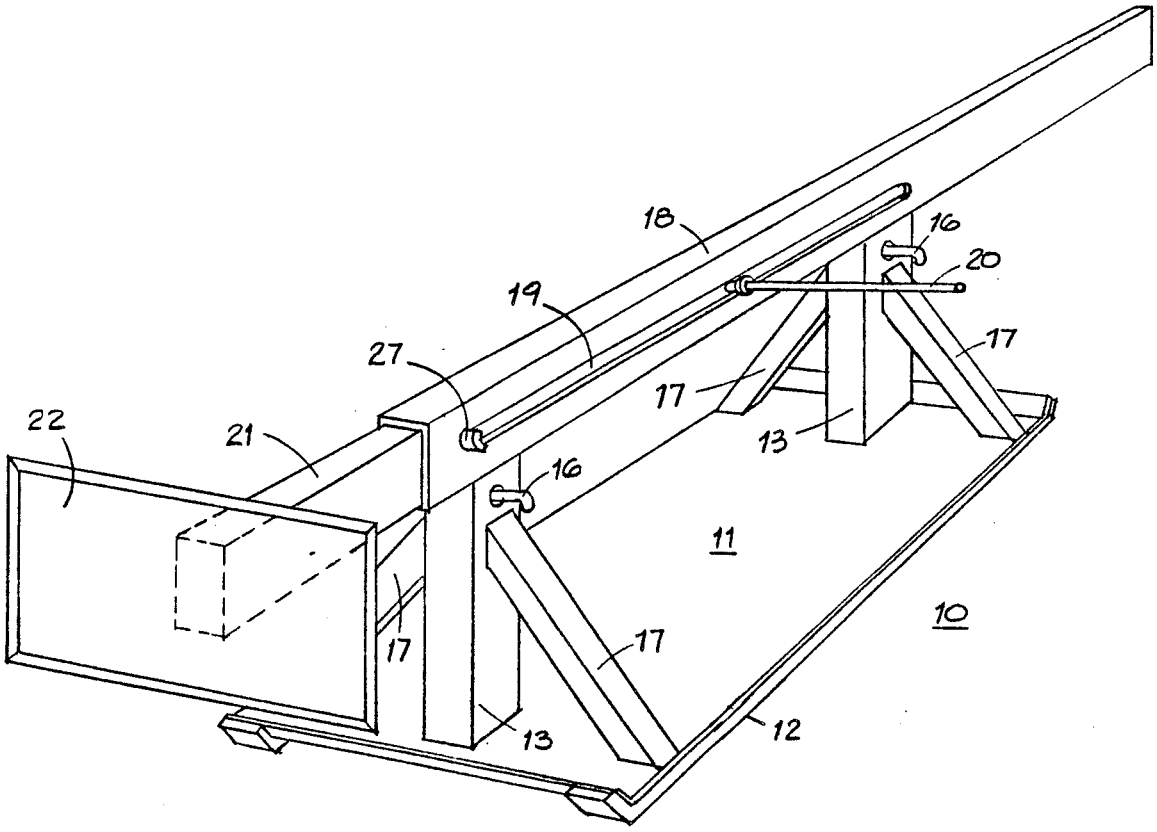
FIG. 4 is a representational perspective view of the football blocking apparatus when configured to simulate a football player attempting a cut block.

FIG. 4 shows my blocking apparatus 10 reconfigured to simulate a football player attempting a cut block. In this situation, blocking plate 22 is realigned to a horizontal position, and the upper vertical support members 14 have been lowered into lower vertical support members 13 to lower the height of blocking plate 22. In this configuration, when the coach or trainer, utilizing thrust bar 20, rapidly and forcefully extends ram 21 out from outer tubular frame member 18, the cut block of an on-rushing football player is simulated.

While there is shown and described the present preferred embodiment of the invention, it is to be distinctly understood that the invention is not limited thereto but may be variously embodied to practice within the scope of the following claims.

Accordingly, what I claim is:

1. A football blocking apparatus which comprises:

an outer tubular frame member and an elongated ram member;

a support means for holding the outer tubular frame member in parallel spaced relationship to the ground;

said outer tubular frame member telescopically receiving and supporting said ram member;

a blocking pad simulating a torso of an on-rushing defensive lineman attached to the extending end of said telescoping ram member;

means for receiving a force from a trainer for selectively and repeatedly extending the blocking pad to simulate the forward rush of a defensive lineman;

means for adjusting the height at which the outer tubular frame member is held in parallel spaced relationship to the ground;

said outer tubular frame member having an elongated slot therein, said slot being parallel to and horizontally extending with respect to the longitudinal axis of said tubular frame member; a thrust bar attached to and extending horizontally from said telescoping ram member through said slot for selectively and repeatedly receiving thrust forces from a trainer to selectively extend and retract said telescoping ram member relative to said outer frame member to simulate the repeated rush of a defensive lineman.

2. A football blocking apparatus which comprises:

a support sled;

a plurality of height adjustable vertical support members holding an outer tubular frame member in parallel spaced relationship to the sled, said height adjustable vertical support members being attached to said sled and extending vertically up therefrom;

an outer tubular frame member, attached to said height adjustable vertical support members and held in parallel spaced relationship to the support sled, said outer tubular frame member having an opening along its longitudinal axis of predetermined size and having an elongated slot disposed in a wall thereof parallel and horizontally extending with respect to the longitudinal axis of said outer tubular frame member;

a telescoping ram having a size and shape of said opening and being slidably received and supported within said outer tubular frame member;

a blocking pad for simulating the torso of an on-rushing football player removably attached to the extending end of the telescoping ram;

a thrust bar attached to and extending horizontally out from said telescoping ram member through said slot, for selectively and repeatedly receiving thrust forces from a trainer to selectively extend or retract said telescoping ram relative to said outer tubular frame member to simulate the repeated rushes of a defensive lineman.

3. The blocking apparatus of claim 2 wherein said blocking pad further comprises:

said blocking pad being removably attachable to the extending end of the telescoping ram in at least two orientations wherein when it is attached in the first orientation it simulates the torso of an on-rushing defensive lineman, and in the second orientation it simulates the torso of a football player attempting a cut block.

* * * * *